US011421892B2

(12) United States Patent
Snyder

(10) Patent No.: US 11,421,892 B2
(45) Date of Patent: Aug. 23, 2022

(54) COOKING AND COOLING APPARATUS

(71) Applicant: Ashley Snyder, Anderson, SC (US)

(72) Inventor: Ashley Snyder, Anderson, SC (US)

( * ) Notice: Subject to any disclaimer, the term of this patent is extended or adjusted under 35 U.S.C. 154(b) by 137 days.

(21) Appl. No.: 16/882,466

(22) Filed: May 23, 2020

(65) Prior Publication Data

US 2020/0378616 A1 Dec. 3, 2020

Related U.S. Application Data

(60) Provisional application No. 62/853,103, filed on May 27, 2019.

(51) Int. Cl.

| | |
|---|---|
| ***F24C 15/18*** | (2006.01) |
| ***F24C 3/02*** | (2021.01) |
| ***F24C 3/06*** | (2021.01) |
| ***F24C 15/10*** | (2006.01) |
| ***F24C 3/08*** | (2006.01) |

(52) U.S. Cl.

CPC ..... *F24C 15/18* (2013.01); *F24C 3/027* (2013.01); *F24C 3/067* (2013.01); *F24C 3/085* (2013.01); *F24C 15/107* (2013.01)

(58) Field of Classification Search

CPC ..... F24C 15/18; F24C 3/027
USPC ..... 126/25 R, 37 R
See application file for complete search history.

(56) References Cited

U.S. PATENT DOCUMENTS

| | | | | |
|---|---|---|---|---|
| 2010/0176170 | A1* | 7/2010 | O'Hare | B60R 9/06 224/519 |
| 2014/0053823 | A1* | 2/2014 | Frantz | A47J 37/0786 126/276 |
| 2018/0073739 | A1* | 3/2018 | Dumenil | F24C 1/02 |

* cited by examiner

*Primary Examiner* — Vivek K Shirsat
(74) *Attorney, Agent, or Firm* — The Iwashko Law Firm, PLLC; Lev Ivan Gabriel Iwashko

(57) ABSTRACT

A cooking and cooling apparatus, including a main body to receive at least one item thereupon, a cooking unit disposed on at least a portion of a top surface of the main body to cook at least one food item thereon, and a cooling unit disposed within at least a portion of the main body to keep contents stored within at a cool temperature.

7 Claims, 1 Drawing Sheet

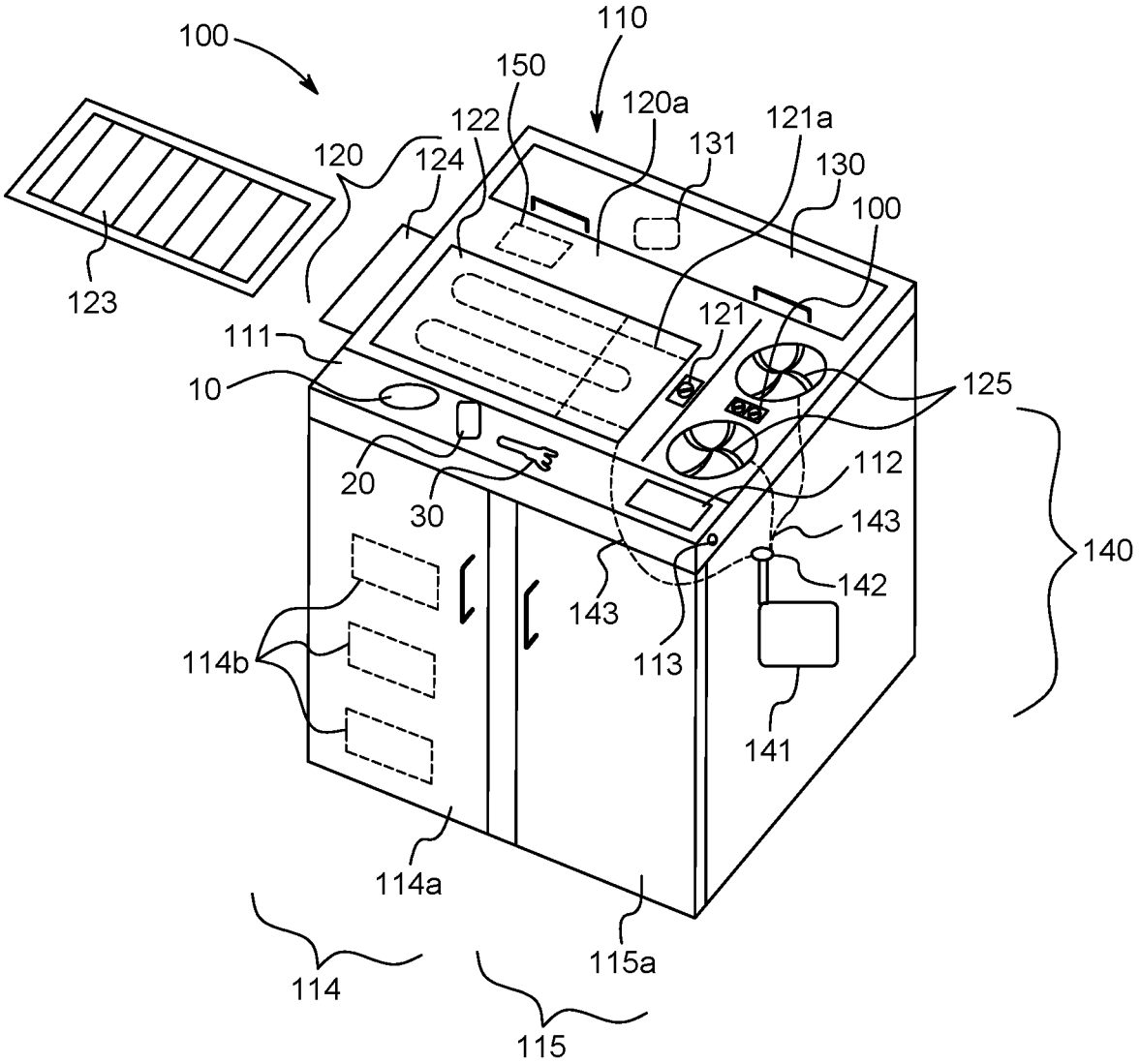
100
110
150
120a
122
121a
131
120
124
130
100
123
121
111
125
10
112
20
30
143
140
142
143
113
114b
141
114a
115a
114
115

COOKING AND COOLING APPARATUS

CROSS-REFERENCE TO RELATED APPLICATIONS

This application claims priority under 35 USC § 120 from U.S. Provisional Application No. 62/853,103, entitled "Cooking and Cooling Apparatus," which was filed on May 27, 2019, in the United States Patent and Trademark Office, the disclosure of which is incorporated herein in its entirety by reference.

BACKGROUND

1. Field

The present general inventive concept relates generally to a cooking apparatus, and particularly, to a cooking and cooling apparatus.

2. Description of the Related Art

Many people enjoy being outdoors. Popular outdoor activities include picnics, fishing, visiting a beach, and/or other similar locations/activities. Typically, people engaging in an outdoor activity, often choose to carry a cooler to keep food and beverages chilled.

Moreover, other outdoor essentials, such as a grill, facilitate enjoyment of outdoor activities and it can be difficult to transport and remember all the items, especially when a person is alone. As such, transporting multiple items increases clutter and requires more storage space.

Therefore, there is a need for a cooking apparatus that includes a cooling unit.

SUMMARY

The present general inventive concept provides a cooking and cooling apparatus.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a cooking and cooling apparatus, including a main body to receive at least one item thereupon, a cooking unit disposed on at least a portion of a top surface of the main body to cook at least one food item thereon, and a cooling unit disposed within at least a portion of the main body to keep contents stored within at a cool temperature.

The main body may include a first storage compartment disposed within at least a portion of a bottom portion of the main body to store the at least one item therein, and a second storage compartment disposed within at least a portion of the bottom portion of the main body.

The cooking and cooling apparatus may further include a fuel unit disposed within at least a portion of the second storage compartment to provide gas to the cooking unit.

The cooking unit may include a heating coil disposed on at least a portion of the cooking unit to emanate heat therefrom, and a plurality of burners disposed on at least a portion of the cooking unit to emanate heat therefrom.

The cooking unit may further include a griddle removably disposed above the heating coil to receive heat from the heating coil.

The cooking unit may further include a grill removably disposed above the heating coil to receive heat from the heating coil.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a top isometric view of a cooking and cooling apparatus, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the FIGURES and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Cooking and Cooling Apparatus 100
Main Body 110
Plate-Receiving Surface 111
Utensil Container 112
Bottle Opener 113
First Storage Compartment 114
First Compartment Door 114*a*
Shelves 114*b*
Second Storage Compartment 115
Second Compartment Door 115*a*
Cooking Unit 120
Top Surface 120*a*
Heating Coil 121
Switch 121*a*
Griddle 122
Grill 123
Drip Pan 124
Burners 125
Switch 125*a*
Cooling Unit 130
Refrigeration Unit 131
Fuel Unit 140
Fuel Tank 141
Splitter 142
Fuel Lines 143
Power Source 150

FIG. 1 illustrates a top isometric view of a cooking and cooling apparatus 100, according to an exemplary embodiment of the present general inventive concept.

The cooking and cooling apparatus 100 may be constructed from at least one of metal, plastic, wood, glass, and rubber, etc., but is not limited thereto.

The cooking and cooling apparatus 100 may include a main body 110, a cooking unit 120, a cooling unit 130, a fuel unit 140, and a power source 150, but is not limited thereto.

The main body 110 may include a plate-receiving surface 111, a utensil container 112, a bottle opener 113, a first storage compartment 114, and a second storage compartment 115, but is not limited thereto.

Referring to FIG. 1, the main body 110 is illustrated to have a rectangular prism shape. However, the main body 110 may be rectangular, circular, pentagonal, hexagonal, octagonal, or any other shape known to one of ordinary skill in the art, but is not limited thereto.

The main body 110 may have a predetermined size based on a preference of a user.

The plate-receiving surface 111 may be disposed on at least a portion of a top surface of the main body 110. The plate-receiving surface 111 may be substantially planar to receive at least one plate 10, at least one beverage container 20, and/or at least one utensil 30 thereupon. The plate-receiving surface 111 may have a smooth surface and/or a textured surface, such as a plurality of bubbled protrusions extending away therefrom. As such, the textured surface may increase friction to prevent the at least one plate 10, the at least one beverage container 20, and/or the at least one utensil 30 from movement.

The utensil container 112 may be disposed within at least a portion of the top surface of the main body 110. In other words, the utensil container 112 may be at least partially recessed with respect to the top surface of the main body 110. The at least one utensil 30 may be stored within the utensil container 112.

The bottle opener 113 may be disposed on at least a portion of the main body 110. The bottle opener 113 may facilitate removal of a bottle cap as disposed on a bottle. Specifically, the user may insert the bottle cap into the bottle opener 113 to push and/or pull the bottle away from the bottle opener 113, such that the bottle cap may be removed.

The first storage compartment 114 may include a first compartment door 114*a* and a plurality of shelves 114*b*, but is not limited thereto.

The first storage compartment 114 may be disposed within at least a bottom portion of the main body 110. The first compartment door 114*a* may be opened to access an interior portion of the first storage compartment 114 and/or closed to prevent access to the interior portion of the first storage compartment 114. Additionally, the user may store at least one item within the interior portion of the first storage compartment 114. For example, the user may store the at least one plate 10, the at least one beverage container 20, and/or the at least one utensil 30 therein. Moreover, the at least one plate 10, the at least one beverage container 20, and/or the at least one utensil 30 may be disposed on at least one of the plurality of shelves 114*b*. In other words, the plurality of shelves 114*b* may receive the at least one plate 10, the at least one beverage container 20, and/or the at least one utensil 30 thereupon.

The second storage compartment 115 may include a second compartment door 115*a*, but is not limited thereto.

The second storage compartment 115 may have a predetermined amount of space therein. The second storage compartment 115 may be disposed within at least a bottom portion of the main body 110.

The cooking unit 120 may include a top surface 120*a*, a heating coil 121, a griddle 122, a grill 123, a drip pan 124, and a plurality of burners 125, but is not limited thereto.

The cooking unit 120 may be disposed on at least a portion of the top surface 120*a* of the cooking unit 120.

The heating coil 121 may include a switch 121*a*, but is not limited thereto.

The heating coil 121 may be turned on and/or off in response to movement of the switch 121*a*. As such, the heating coil 121 may heat up in response to the switch 121*a* being turned on in a first position. Alternatively, the heating coil 121 may cool down in response to the switch 121*a* being turned off in a second position.

The griddle 122 may be removably disposed above the heating coil 121. In other words, the heating coil 121 may be disposed within at least a portion of the main body 110 below the griddle 122. Additionally, at least a portion of the griddle 122 may contact at least a portion of the heating coil 121, such that the griddle 122 may heat up in response to heat from the heating coil 121 being emanated therefrom. Moreover, the griddle 122 may be a flat surface. As such, the griddle 122 may evenly distribute heat received from the heating coil 121 across a top surface of the griddle 122.

Furthermore, the griddle 122 may include a smooth surface and/or a textured surface, such as a plurality of bubbled protrusions extending away therefrom. As such, the textured surface may increase friction to prevent movement of items disposed thereupon. For example, the textured surface may prevent food from movement across the griddle 122 while the food is disposed thereupon.

Alternatively, the user may exchange the griddle 122 with the grill 123. In other words, the grill 123 may be removably disposed above the heating coil 121. Additionally, at least a portion of the grill 123 may contact at least a portion of the heating coil 121, such that the grill 123 may heat up in response to heat from the heating coil 121 being emanated therefrom. As such, the grill 123 may evenly distribute heat received from the heating coil 121 across a top surface of the grill 123.

The drip pan 124 may be disposed within at least a portion of the main body 110 below the heating coil 121, such that any liquid and/or any solid runoff from the grill 123 may be collected therein. As such, the drip pan 124 may be extracted from the main body 110 to dispose of any runoff contained therein.

Each of the plurality of burners 125 may include a switch 125*a*, but is not limited thereto.

Referring again to FIG. 1, the plurality of burners 125 are illustrated as a gas cooktop. However, the plurality of burners 125 may be a radiant cooktop, an induction cooktop, and/or a coil cooktop, but is not limited thereto. For sake of brevity, the plurality of burners 125 will hereinafter be described as the gas cooktop. The gas cooktop may include an igniter, but is not limited thereto.

Each of the plurality of burners 125 may be turned on and/or off in response to movement of the switch 125*a*. As such, each of the plurality of burners 125 may heat up in response to the switch 125*a* being turned on in another first position. Alternatively, each of the plurality of burners 125 may cool down in response to the switch 125*a* being turned off in another second position.

The cooling unit 130 may include a refrigeration unit 131, but is not limited thereto.

The cooling unit 130 may be disposed within at least a portion of the main body 110. The cooling unit 130 may be an insulated storage unit, such that ice may be stored therein to keep contents within the cooling unit 130 at a cool temperature. Alternatively, the refrigeration unit 131 may be any type of refrigeration system known to one of ordinary skill in the art, which may include a condenser, a fan, a coolant/refrigerant, a coil system, etc. As such, the refrigeration unit 131 may inject cold air within the cooling unit 130.

The fuel unit 140 may include a fuel tank 141, a splitter 142, and a plurality of fuel lines 143, but is not limited thereto.

The fuel unit 140 may be disposed within at least a portion of the second storage compartment 115. The second compartment door 115*a* may be opened to access an interior portion of the second storage compartment 115 and/or closed to prevent access to the interior portion of the second storage compartment 114. For example, the user may access the fuel unit 140 within the second storage compartment 115 to adjust a setting of the fuel unit 140 and/or replace the fuel tank 141. Although, the fuel unit 140 may be described as a gas unit, the fuel unit 140 may be an electrical power source and/or a magnetic induction unit depending on a type of the plurality of burners 125.

The fuel tank 141 may store a gas therein. The gas may be extracted from the gas unit in response to the switch 121*a* of the heating coil 121 and/or the switch 125*a* of at least one of the plurality of burners 125 being turned on. Additionally, the gas may flow through the splitter 142 to separate the gas to flow through each of the plurality of fuel lines 143, such that the fuel may reach the heating coil 121 and/or the at least one of the plurality of burners 125. In other words, at least one of the plurality of fuel lines 143 may be connected to the splitter 142 at a first end and the heating coil 121 at a second end. Similarly, at least one of the plurality of fuel lines 143 may be connected to the splitter 142 at another first end and at least one of the plurality of burners 125 at another second end.

Moreover, the igniter may ignite the gas to create a flame to heat the heating coil 121 and/or the at least one of the plurality of burners 125. As such, the user may cook at least one food item on the griddle 122, the grill 123, and/or the at least one of the plurality of burners 125.

The power source 150 may include a power cord, a battery, a solar cell, but is not limited thereto. Additionally, the battery may include lithium-ion, nickel cadmium, nickel metal hydride, alkaline, etc., but is not limited thereto.

The power source 150 may send power to at least one of the display unit 121*b* and the refrigeration unit 131.

Therefore, the cooking and cooling apparatus 100 may reduce clutter due to including the cooking unit 120 and cooling unit 130 on a single apparatus. Moreover, the user may not have to remember carrying multiple items while participating in outdoor activities, such as picnics, fishing, visiting a beach, and/or other similar activities. Also, the cooking and cooling apparatus 100 may appeal to hunters, fishermen, beachgoers, retail stores, and/or recreation industries. As such, the cooking and cooling apparatus 100 may improve an experience of the user engaging in any tailgating party.

The present general inventive concept may include a cooking and cooling apparatus 100, including a main body 110 to receive at least one item thereupon, a cooking unit 120 disposed on at least a portion of a top surface of the main body 110 to cook at least one food item thereon, and a cooling unit 130 disposed within at least a portion of the main body 110 to keep contents stored within at a cool temperature.

The main body 110 may include a first storage compartment 114 disposed within at least a portion of a bottom portion of the main body 110 to store the at least one item therein, and a second storage compartment 115 disposed within at least a portion of the bottom portion of the main body 110.

The cooking and cooling apparatus 100 may further include a fuel unit 140 disposed within at least a portion of the second storage compartment 115 to provide gas to the cooking unit 120.

The cooking unit 120 may include a heating coil 121 disposed on at least a portion of the cooking unit 120 to emanate heat therefrom, and a plurality of burners 125 disposed on at least a portion of the cooking unit 120 to emanate heat therefrom.

The cooking unit 120 may further include a griddle 122 removably disposed above the heating coil 121 to receive heat from the heating coil 121.

The cooking unit 120 may further include a grill 123 removably disposed above the heating coil 121 to receive heat from the heating coil 121.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A cooking and cooling apparatus, comprising:

a main body to receive at least one item thereupon;

a cooking unit disposed on at least a portion of a top surface of the main body to cook at least one food item on a first portion of the top surface of the main body and another at least one food item on a second portion of the top surface of the main body that is separate and distanced away from the first portion of the top surface of the main body, such that the second portion is different from the first portion;

a cooling unit disposed within at least a portion of the main body to keep contents stored within at a cool temperature; and a refrigeration unit that injects cold air into the cooling unit and wherein the cooling unit is accessible through the top surface of the main body.

2. The cooking and cooling apparatus of claim 1, wherein the main body comprises:

a first storage compartment disposed within at least a portion of a bottom portion of the main body to store the at least one item therein; and a second storage compartment disposed within at least a portion of the bottom portion of the main body.

3. The cooking and cooling apparatus of claim 2, further comprising:

a fuel unit disposed within at least a portion of the second storage compartment to provide gas to the cooking unit.

4. The cooking and cooling apparatus of claim 1, wherein the cooking unit comprises:

a heating coil disposed on at least a portion of the cooking unit to emanate heat therefrom; and a plurality of burners disposed on at least a portion of the cooking unit to emanate heat therefrom.

5. The cooking and cooling apparatus of claim 4, wherein the cooking unit further comprises:

a griddle removably disposed above the heating coil to receive heat from the heating coil.

6. The cooking and cooling apparatus of claim 4, wherein the cooking unit further comprises:

a grill removably disposed above the heating coil to receive heat from the heating coil.

7. A cooking and cooling apparatus, comprising:

a main body, comprising:

a plate-receiving surface to receive at least one item thereon, such that the plate-receiving surface is textured to prevent the at least one item from movement, a utensil container to store at least one utensil therein, such that the utensil container is recessed with respect to the plate-receiving surface, and a bottle opener to facilitate removal of a bottle cap from a bottle;

a cooking unit disposed on at least a portion of a top surface of the main body to cook at least one food item thereon;

a cooling unit disposed within at least a portion of the main body to keep contents stored within at a cool temperature; and a refrigeration unit that injects cold air into the cooling unit and wherein the cooling unit is accessible through the top surface of the main body.

* * * * *